US005953980A

United States Patent [19]

Ota et al.

[11] Patent Number: 5,953,980

[45] Date of Patent: Sep. 21, 1999

[54] PISTON TYPE COMPRESSORS

[75] Inventors: Masaki Ota; Hisakazu Kobayashi, both of Kariya, Japan

[73] Assignee: Kabushiki Kaisha Toyoda Jidoshokki Seisakusho, Aichi-ken, Japan

[21] Appl. No.: 08/957,231

[22] Filed: Oct. 24, 1997

[30] Foreign Application Priority Data

Oct. 25, 1996 [JP] Japan ..... 8-284270

[51] Int. Cl.[6] ..... F01B 3/00

[52] U.S. Cl. ..... 92/71; 92/172

[58] Field of Search ..... 92/70, 71, 172; 417/269

[56] References Cited

U.S. PATENT DOCUMENTS

| | | | |
|---|---|---|---|
| 3,746,475 | 7/1973 | Johnson | 417/269 |
| 3,885,460 | 5/1975 | Park . | |
| 5,174,728 | 12/1992 | Kimura et al. . | |
| 5,382,139 | 1/1995 | Kawaguchi et al. . | |
| 5,461,967 | 10/1995 | Burkett et al. | 92/71 |
| 5,615,599 | 4/1997 | Terauchi | 92/71 |
| 5,630,353 | 5/1997 | Mittlefehldt et al. | 92/71 |

FOREIGN PATENT DOCUMENTS

| | | |
|---|---|---|
| 0 410 453 A1 | 1/1991 | European Pat. Off. . |
| 0698735 | 2/1996 | European Pat. Off. . |
| 496065 | 3/1930 | Germany . |
| 24 09 877 | 10/1978 | Germany . |
| 08226381 | 9/1996 | Japan . |
| 08254180 | 10/1996 | Japan . |

*Primary Examiner*—F. Daniel Lopez
*Attorney, Agent, or Firm*—Morgan & Finnegan L.L.P.

[57] ABSTRACT

A piston for use in a compressor is disclosed. The piston has a head for compressing gas and a skirt connected to a swash plate. A first seal and a second seal, which always contact a cylinder bore, are defined on the head. An annular groove is formed between the first and second seals. Lateral forces acting on the piston are received by the first and second seals. A space is formed in the piston to open to the side of the piston between the second seal and the skirt. This reduces the weight of the piston and stabilizes the movement of the piston.

9 Claims, 4 Drawing Sheets

PISTON TYPE COMPRESSORS

BACKGROUND OF THE INVENTION

The present invention relates to piston type compressors that convert the rotation of a drive shaft to linear reciprocation of pistons by means of drive bodies such as swash plates, and more particularly, to pistons for the same.

A typical compressor includes a crank chamber that is defined in a housing. A drive shaft is rotatably supported in the housing. Part of the housing is constituted by a cylinder block. A plurality of cylinder bores extend through the cylinder block. Each cylinder bore accommodates a piston. A swash plate is fitted to the drive shaft in the crank chamber and supported so as to rotate integrally with the drive shaft. Shoes are provided to couple each piston to the peripheral portion of the swash plate. The swash plate converts the rotation of the drive shaft to linear reciprocation of the pistons. The reciprocation of the pistons compresses refrigerant gas.

There is a type of compressor that has a variable displacement. Such a compressor changes the inclination of the swash plate with respect to the drive shaft. The difference between the pressure in the crank chamber and the pressure in the cylinder bores influences the swash plate through the pistons. Thus, the inclination of the swash plate is determined by the pressure difference. Changes in the inclination of the swash plate alters the stroke of the pistons and varies the displacement of the compressor. In a variable displacement compressor, it is required that the pistons be as light as possible to enable stable control of the displacement under high speed conditions.

Japanese Unexamined Patent Application No. 8-61237 describes a light compressor piston. A generally annular space is provided in the body of each piston. A pair of arms project from the crank chamber end of each piston in a direction substantially perpendicular to the axis of the piston. A groove is defined in the distal end of each arm. A guide rod extends in the axial direction of the pistons between each pair of adjacent cylinder bores. Each guide rod is slidably held between a pair of adjacent arms extending from the associated pair of adjacent pistons. This structure restricts the rotation of each piston. Furthermore, lateral forces applied to each piston (forces acting in a direction perpendicular to the axial direction of the piston) are transmitted through the arms and received by the guide rods.

The inertial force acting on each piston becomes greatest when the piston shifts from the suction stroke to the compression stroke, that is, when the piston becomes close to the bottom dead center. The inertial force of the piston acts on the swash plate. On the other hand, the piston receives reaction force from the swash plate. Due to the inclination of the swash plate, a portion of the reaction force acts in a lateral direction and presses the piston against the wall of the associated cylinder bore. In addition, frictional force is produced between the swash plate and the piston. This produces a further lateral force that tends to incline the piston in the rotating direction of the swash plate. This lateral force also acts in a direction that presses the piston against the wall of the cylinder bore. Such lateral force is transmitted through the associated arms and is received by the guide rods.

In the compressor of the above publication, dimensional differences are produced between the arm grooves and the guide rods when assembling the compressor. To reduce such dimensional differences, the compressor components must be machined accurately. Thus, the machining of these compressor parts is difficult. Furthermore, the guide rods extend through the crank chamber from the front housing and into the cylinder block. The guide rods are fixed to the cylinder block. When installing the guide rods, the guide rods must be inserted through the grooves of opposing arms which is burdensome.

To facilitate the insertion of guide rods between the grooves of opposing arms, a greater clearance may be provided between the wall of the grooves and the guide rods. However, such clearance would result in the guide rods hitting the groove walls when receiving lateral force. This produces undesirable noise.

SUMMARY OF THE INVENTION

Accordingly, it is an objective of the present invention to provide a compressor provided with pistons that facilitate machining and that are easily installed in the compressor while also being stable and light.

To achieve the above objective, the present invention provides a piston type compressor and a piston for installation and use in the compressor. The compressor includes a cylinder bore for accommodating the piston. The cylinder bore is defined by a surface slidably supporting the piston. The compressor further includes a driving body supported on a drive shaft. The driving body is operably connected to the piston to convert rotation of the drive shaft to reciprocation of the piston. The piston comprises a head for compressing gas supplied to the cylinder bore. The head is located at a first end of the piston. The piston has a second end opposite to the first end. A skirt is formed at the second end. The skirt is formed to couple with the driving body. A first seal and a second seal are located at the first end of the piston. The first and second seals each have peripheral surfaces that always contact the surface of the cylinder bore when the piston is installed. An annular groove is located between the first seal and the second seal. When the piston is installed and when a force acts on the piston in a direction transverse to the axis of the piston, the force is received by at least one of the first and second seals. A space opens to the side of the piston. The space is located between the second seal and the skirt. A bridge is located between the second seal and the skirt to connect the second seal with the skirt.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a variable displacement compressor according to the present invention will now be described with reference to FIGS. 1 and 2.

Figure 1:
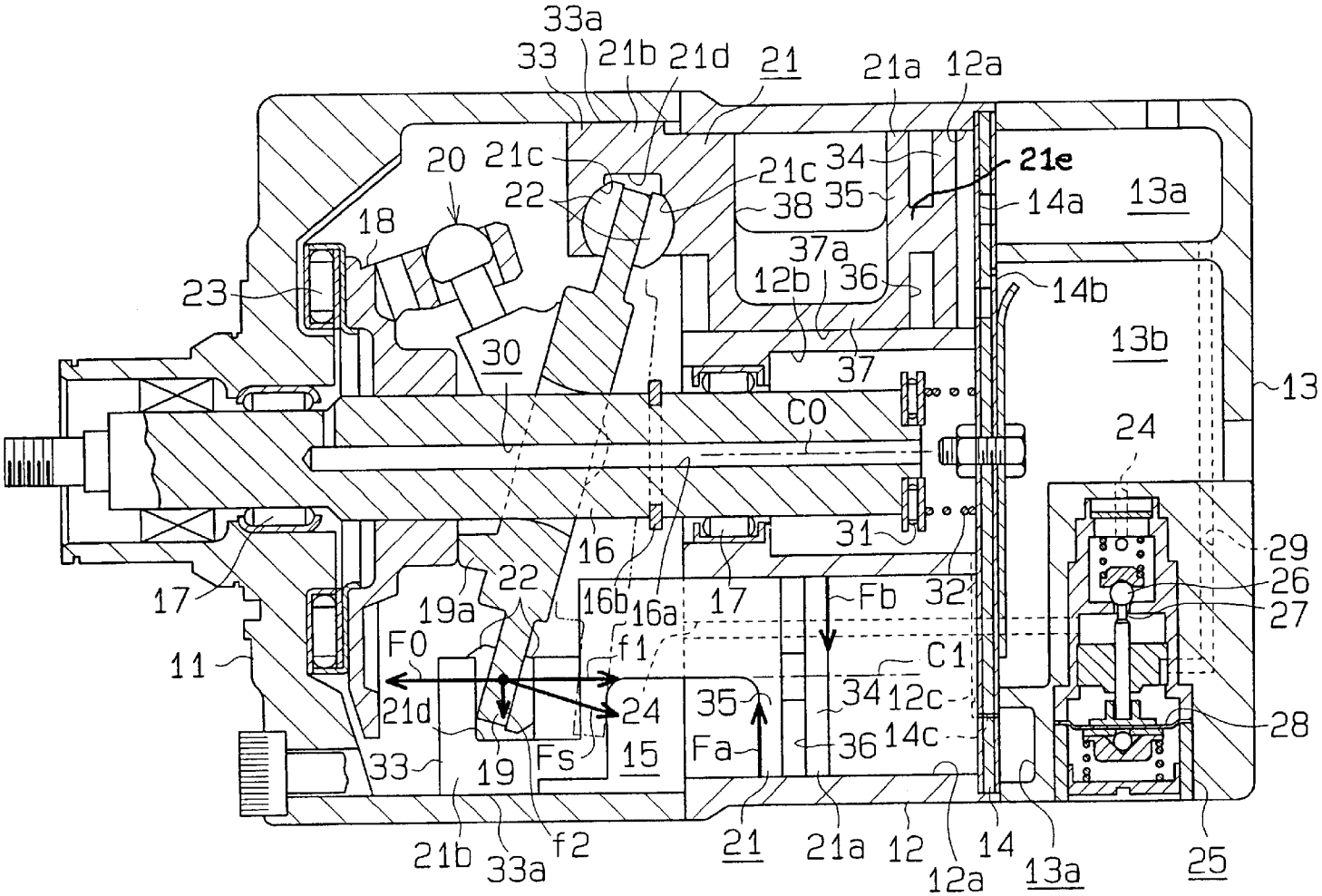
FIG. 1 is a cross-sectional view showing a first embodiment of a compressor according to the present invention.
Figure 2:
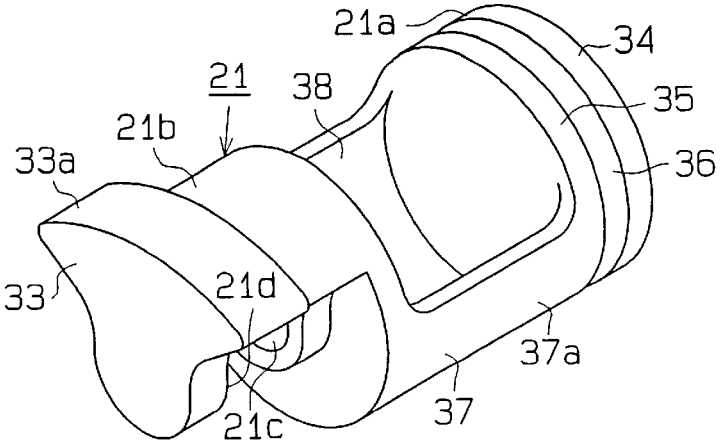
FIG. 2 is a perspective view showing the piston of the compressor of FIG. 1.

As shown in FIG. 1, a front housing 11 is coupled to the front end of a cylinder block 12. A rear housing 13 is coupled to the rear end of the cylinder block 12. The front housing 11, the cylinder block 12, and the rear housing 13 constitute a housing of the compressor.

A suction chamber 13*a* and a discharge chamber 13*b* are defined in the rear housing 13. A valve plate 14 having suction flaps 14*a* and discharge flaps 14*b* is arranged between the rear housing 13 and the cylinder block 12. A crank chamber 15 is defined in the front housing 11 in front of the cylinder block 12. A drive shaft 16 extends through the crank chamber 15 between the front housing 11 and the cylinder block 12. A pair of radial bearings 17 rotatably support the drive shaft 16.

A rotor 18 is fixed to the drive shaft 16. A swash plate 19 is fitted to the drive shaft 16 in the crank chamber 15. The swash plate 19 is supported so that it is slidable in the axial direction of the drive shaft 16 and inclinable with respect to the drive shaft 16. The swash plate 19 is connected to the rotor 18 by means of a hinge mechanism 20. The hinge mechanism 20 guides the movement of the swash plate 19 in the axial direction of the drive shaft 16 and the inclination of the swash plate 19 with respect to the drive shaft 16. The hinge mechanism 20 also rotates the swash plate 19 integrally with the drive shaft 16.

A stopper 19*a* is provided on the front surface of the swash plate 19. The abutment of the stopper 19*a* against the rotor 18 determines the maximum inclination position of the swash plate 19. A stopper ring 16*b* is provided on the drive shaft 16. The abutment of the swash plate 19 against the stopper ring 16*b* restricts further inclination of the swash plate 19 and thus determines the minimum inclination position of the swash plate 19.

A plurality of cylinder bores 12*a* extend through the cylinder block 12 about the drive shaft 16. A single-headed piston 21 is reciprocally accommodated in each cylinder bore 12*a*. Each piston 21 has a head 21*a*, which is retained in the cylinder bore 12*a*, and a skirt 21*b*, which projects from the head 21*a* toward the crank chamber 15. The skirt 21*b* is provided with a slot 21*d* facing the swash plate 19. A concave receiving surface 21*c* is defined in each of the opposing walls of the slot 21*d*. Each receiving surface 21*c* receives the semispherical portion of a shoe 22.

The periphery of the swash plate 19 is fitted into the slot 21*d* of each piston 21 and slidably held between the flat portions of the associated pair of shoes 22. The rotation of the drive shaft 16 is converted to linear reciprocation of the piston 21 in the associated cylinder bore 12*a* by means of the swash plate 19 and the shoes 22. When the piston 21 is moved from the top dead center to the bottom dead center during the suction stroke, the refrigerant gas in the suction chamber 13*a* opens the associated suction flap 14*a* and flows into the cylinder bore 12*a*. When the piston 21 is moved from the bottom dead center to the top dead center during the compression stroke, the refrigerant gas in the cylinder bore 12*a* is compressed. The compressed gas opens the associated discharge flap 14*b* and flows into the discharge chamber 13*b*.

A thrust bearing 23 is arranged between the rotor 18 and the front wall of the front housing 11. The front housing 11 receives the reaction force that acts on each piston 21 during compression of the gas by way of the shoes 22, the swash plate 19, the hinge mechanism 20, the rotor 18, and the thrust bearing 23.

A pressurizing passage 24 extends through the cylinder block 12, the valve plate 14, and the rear housing 15 to connect the suction chamber 13*b* with the crank chamber 15. A displacement control valve 25 is arranged in the rear housing 13 with the pressurizing passage 24 extending therethrough. The control valve 25 has a valve hole 27, a valve body 26 faced toward the valve hole 27, and a diaphragm 28 for adjusting the opened area of the valve hole 27. A pressure communicating passage 29 is provided to communicate the pressure of the suction chamber 13*a* (suction pressure) to the diaphragm 28. The diaphragm 28 moves the valve body 26 and adjusts the area of the valve hole 27 opened by the valve body 26 in accordance with the communicated pressure.

The control valve 25 alters the amount of refrigerant gas flowing into the crank chamber 15 through the pressurizing passage 24 from the discharge chamber 13*b* and adjusts the pressure of the crank chamber 15. Changes in the pressure of the crank chamber 15 alter the difference between the pressure of the crank chamber 15 acting on the bottom surface of each piston 21 (the left surface as viewed in FIG. 1) and the pressure of the associated cylinder bore 12*a* acting on the head surface of the piston 21 (the right surface as viewed in FIG. 1). The inclination of the swash plate 19 is altered in accordance with changes in the pressure difference. This, in turn, alters the stroke of the piston 21 and varies the displacement of the compressor.

A pressure relieving passage 30 connects the crank chamber 15 to the suction chamber 13*a*. The relieving passage 30 is constituted by an axial passage 16*a* extending through the center of the drive shaft 16, a retaining bore 12*b* defined in the center of the cylinder block 12, a pressure releasing groove 12*c* extending through the rear surface of the cylinder block 12, and a pressure releasing bore 14*c* extending through the valve plate 14. The inlet of the axial passage 16*a* is connected with the crank chamber 15 at the vicinity of the front radial bearing 17. A certain amount of the refrigerant gas in the crank chamber 15 is constantly drawn into the suction chamber 13*a* through the relieving passage 30.

A thrust bearing 31 and a coil spring 32 are arranged in the retaining bore 12*b* between the rear end of the drive shaft 16 and the valve plate 14.

The structure of the pistons 21 will now be described in detail. As shown in FIGS. 1 and 2, each piston 21 has a generally T-shaped rotation restriction 33 defined at the end of the skirt 21*b*. The restriction 33 includes an arc surface 33*a* that faces the inner wall of the front housing 11. The radius of curvature of the arc surface 33*a* is substantially the same as that of the inner wall of the front housing 11*a*. When the piston 21 moves reciprocally, the arc surface 33*a* of the restriction is in comes into surface contact with the inner wall of the front housing 11. This prevents the piston 21 from rotating about its axis C1.

Each piston 21 has two parts of the head 21*a*. One is a first seal 34 defined at the periphery of the head 21*a*. The peripheral surface of the first seal 34 slides along the wall of the associated cylinder bore 12*a*. The other part of the head 21*a* is a second seal 35 which is provided near the first seal 34. The first and second seals are separated by a rod 21*e*. An annular groove 36 or gap is defined between the first and second seals 34, 35. The peripheral surface of the second seal 35 also slides along the wall of the associated cylinder bore 12*a*. The second seal 35 is located such that it never moves out of the cylinder bore 12*a* and thus is never exposed to the crank chamber 15*a* even when the piston 21 is located at the bottom dead center in a maximum piston stroke state (a state in which the swash plate 19 is located at the maximum inclination position). In other words, the second seal 35 always remains inside the cylinder bore 12*a*. The first and second seals 34, 35 function to receive lateral forces, or forces transverse to the axis of the pistons 21, which will be described later.

A space 38 is defined at the middle of the piston 21. The space 38 opens toward a lateral direction of the piston 21. Due to the space 38, the middle of the piston 21 has a C-shaped cross-section. The C-shaped portion functions as a bridge 37 for bridging the second seal 35 and the skirt 21*b*. The outer surface of the bridge 37 constitutes a sliding surface 37*a* that slides against the inner wall of the cylinder bore 12*a*. The sliding surface 37*a* is semi-cylindrical, and it faces toward the axis C0 of the swash plate 19 (or drive shaft 16). The extremities of the surface 37*a* face generally toward the adjacent pistons 21, that is, they face directions that are generally tangential to the swash plate 19 with respect to a tangent taken at the location of the shoes 22.

The annular groove 36 and the space 38 may be formed during molding of the piston 21. They may also be formed by machining the surface of the molded piston 21. The annular groove 36 and the space 38 decrease the weight of the piston The operation of the above variable displacement compressor will now be described.

The drive shaft 16 is rotated by an external drive means such as an automobile engine. The swash plate 19 is integrally rotated with the drive shaft 16 by means of the rotor 18 and the hinge mechanism 20. The rotation of the swash plate 19 is converted to linear reciprocation of each piston 21 in the associated cylinder bore 12*a* by the shoes 22. The reciprocation of the piston 21 draws the refrigerant gas in the suction chamber 13*a* into the cylinder bore 12*a* through the associated suction flap 14*a*. When the refrigerant gas in the cylinder bore 12*a* is compressed to a predetermined pressure, the gas is discharged into the discharge chamber 13*b* through the associated discharge flap 14*b*.

During operation of the compressor, if the cooling demand becomes great and the load applied to the compressor increases, high pressure in the suction chamber 13*a* acts on the diaphragm 28 of the control valve 25 causing the valve body 26 to close the valve hole 27. This closes the pressurizing passage 26 and stops the flow of high pressure refrigerant gas from the discharge chamber 13*b* to the crank chamber 15. In this state, the refrigerant gas in the crank chamber 15 is released into the suction chamber 13*a* through the relieving passage 30. This decreases the pressure of the crank chamber 15. Thus, the difference between the pressure in the crank chamber 15 and the pressure in the cylinder bores 12*a* becomes small. As a result, the swash plate is moved to the maximum inclination position, as shown by the solid lines in FIG. 1, and the stroke of the piston 21 becomes maximum. In this state the displacement of the compressor is maximum.

If the cooling demand decreases and the load applied to the compressor decreases, low pressure in the suction chamber 13*a* acts on the diaphragm 28 of the control valve 25 and causes the valve body 26 to open the valve hole 27. This communicates the high pressure refrigerant gas in the discharge chamber 13*b* to the crank chamber 15 through the pressurizing passage 26 and increases the pressure of the crank chamber 15. Thus, the difference between the pressure in the crank chamber 15 and the pressure in the cylinder bores 12*a* becomes large. As a result, the swash plate moves toward the minimum inclination position and decreases the stroke of the piston 21. In this state the displacement of the compressor becomes small.

The diaphragm 28 adjusts the area of the valve hole 27 opened by the valve body 26 in accordance with the suction pressure it receives. The opened area of the valve hole 27 alters the flow rate of the refrigerant gas sent to the crank chamber 15 from the discharge chamber 13*b* and changes the pressure of the crank chamber 15. Changes in the pressure of the crank chamber 15 alter the inclination of the swash plate 19. Accordingly, the compressor displacement is optimally controlled by changing the suction pressure.

The lateral forces applied to each piston 21 during operation of the compressor will now be described.

Lateral force refers to a force applied to the piston 21 by the wall of the associated cylinder bore 12*a* (reaction force) when the peripheral surface of the piston 21 presses against the wall of the cylinder bore 12*a*. For example, when the piston 21 shifts from the suction stroke to the compression stroke, that is, when the piston 21 is in the vicinity of the bottom dead center, like the lower piston 21 shown in FIG. 1, the inertial force acting on the piston 21 becomes maximum. In FIG. 1, the inertial force acting on the piston 21 is denoted by F0. The inertial force F0 of the piston 21 is applied to the swash plate 19. Accordingly, the piston 21 receives reaction force Fs, which is associated with the inertial force F0, from the inclined swash plate 19. The reaction force Fs is divided into component force f1, which acts in the axial direction of the piston 21, and component force f2, which acts in the radial direction of the piston 21. The component force f2 inclines the skirt 21*b* of the piston 21 in the direction of the component force f2.

Therefore, the periphery of the second seal 35 near the bridge 37 is pressed by the wall of the cylinder bore 12*a* by a force corresponding to the component force f2. In other words, the second seal 35 receives reaction force (lateral force) Fa, which is associated with the component force f2, from the wall of the cylinder bore 12*a*. Furthermore, the peripheral surface at the front end of the first seal 34 receives a reaction force (lateral force) Fb, which is associated with the component force f2, from the wall of the cylinder bore 12*a*.

Accordingly, the lateral force applied to the piston 21 is received by the seals 34, 35, between which the annular groove 36 is located. This stabilizes the reciprocating movement of the piston 21. Thus, unlike the prior art compressor, there is no need to provide a structure in the skirt 21*b* of the piston 21 to receive the lateral forces applied to the piston 21. Furthermore, the restriction 33 provided on the skirt 21*b* has a simple structure. Hence, the piston 21 has a simple form. This facilitates the machining of the pistons 21 and simplifies the assembly of the compressor.

A lateral force that tends to incline the piston 21 in the rotating direction of the swash plate 19 is produced by the frictional force between the swash plate 19 and the shoes 22. The lateral force presses the piston 21 against the wall of the cylinder bore 12*a*. This lateral force is received by the sliding surface 37*a* that faces toward the axis of the swash plate 19. This further stabilizes the reciprocating movement of the piston 21.

A large compression reaction force acts on the pistons 21 when they are in the vicinity of their top dead center positions, like the upper piston 21 shown in FIG. 1. This compression reaction force acting on the piston 21 is applied to the swash plate 19. Hence, the piston 21 receives a reaction force, which is associated with the compression reaction force, from the inclined swash plate 19. Part of the reaction force acts as a lateral force that inclines the skirt 2*b* of the piston 21 inward toward the axis C0 of the swash plate 19 (and the drive shaft 16). Thus, a lateral force acts again on the piston 21. The lateral force is received by the sliding surface 37*a*, which faces toward the axis C0 of the swash plate 19. This further stabilizes the reciprocating movement of the piston 21.

If the difference between the pressure of the compression chamber defined in each cylinder bore 12*a* and the pressure of the crank chamber 15 becomes large, the refrigerant gas in the compression chamber is apt to leak into the crank chamber 15 through the gap between the associated piston 21 and the wall of the cylinder bore 12*a*. However, the piston of this embodiment is provided with the annular groove 36 between the first seal 34, which is located at the compression chamber side of the groove 36, and the second seal 35, which is located at the crank chamber side of the groove 36. The pressure in the annular groove 36 is lower than the pressure of the compression chamber and higher than the pressure of the crank chamber 15. Thus, the annular groove 36 absorbs sudden pressure changes in the compression chamber and the crank chamber 15. In addition, the two seals 34, 35 provide a two-step sealing structure between the compression chamber and the crank chamber. This positively seals the space between the piston 21 and the cylinder bore 12*a* and effectively suppresses leakage of refrigerant gas into the crank chamber 15 from the compression chamber.

The annular groove 36 and the space 38 decrease the weight of the piston 21. This decreases the inertial force of the piston 21. Thus, the lateral force associated with the inertial force is decreased. This suppresses abrasion caused by the sliding of the piston 21 along the wall of the cylinder bore 12*a* and stabilizes the reciprocating movement of the piston 21. As each piston 21 reaches the vicinity of the bottom dead center, a large inertial force acts in a direction that increases the inclination of the swash plate 19. Thus, the influence that the inertial force of the piston 21 has on the inclination of the swash plate 19 is reduced as the inertial force becomes smaller. Accordingly, due to the lighter weight of the piston 21 in this embodiment, the displacement of the compressor is controlled in a more stable manner.

Pistons having hollow spaces to decrease weight are known in the prior art. Such hollow pistons are manufactured by joining two hollow cylindrical members. However, this manufacturing method is burdensome. In comparison, the piston 21 of this embodiment is provided with the space 38, which is opened toward the side of the piston 21. The space 38 is formed easily during molding of the piston 21 or when machining the surface of the molded piston 21. Accordingly, in comparison to the hollow pistons of the prior art, the light weight piston 21 is easier to manufacture.

A second embodiment according to the present invention will now be described. Parts differing from the first embodiment will now be described in detail.

Figure 3:
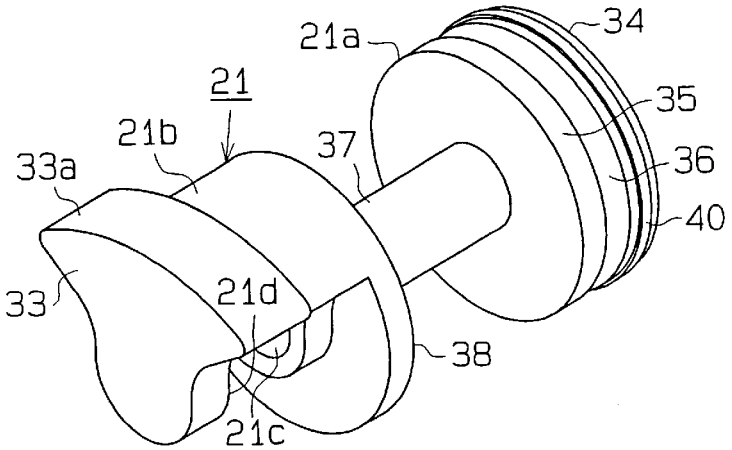
FIG. 3 is a perspective view showing a piston employed in a second embodiment according to the present invention.
Figure 4:
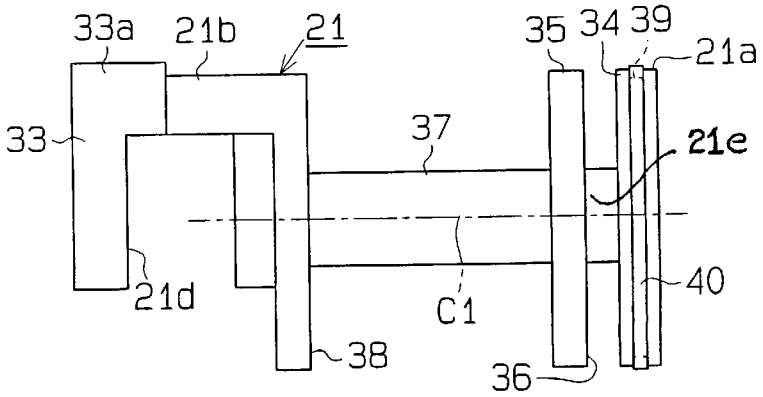
FIG. 4 is as plan view showing the piston of FIG. 3.

As shown in FIGS. 3 and 4, the space 38 is annular and opens toward the periphery of the piston 21. The bridge 37 is provided along the axis of the C1 of the piston 21 between the skirt 21*b* and the second seal 35. An annular groove 39 extends about the periphery of the first seal 34 to receive a piston ring 40.

In the same manner as the first embodiment, the lateral forces associated with the inertial force of the piston 21 are received by the first and second seals 34, 35. Like the first embodiment, the machining of the pistons 21 and the assembly of the compressor is facilitated. The piston 21 of this embodiment is also light.

The space 38 extends about the entire piston 21. This effectively reduces the weight of the piston 21. The compression reaction force acting on the head 21*a* is transmitted by the bridge 37 extending along the axis C1 of the piston 21. The bridge 37 is sized to guarantee adequate strength.

The piston ring 40 arranged on the first seal 34 further positively seals the space between the first seal 34 and the wall of the cylinder bore 12*a*. The piston ring 40 may also be arranged on the second seal 35 or arranged only on the second seal 35 in lieu of the first seal 34.

A third embodiment according to the present invention will now be described. Parts differing from the first embodiment will now be described in detail.

Figure 5:
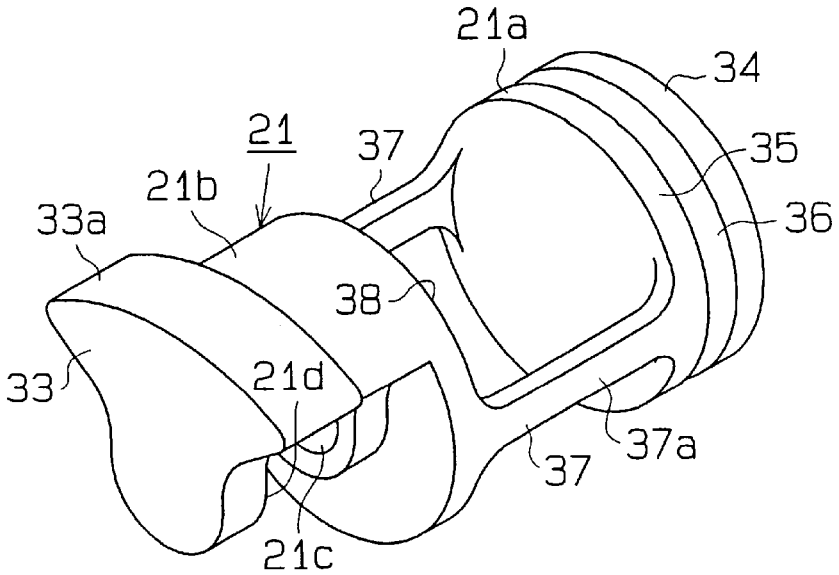
FIG. 5 is a perspective view showing a piston employed in a third embodiment according to the present invention.
Figure 6:
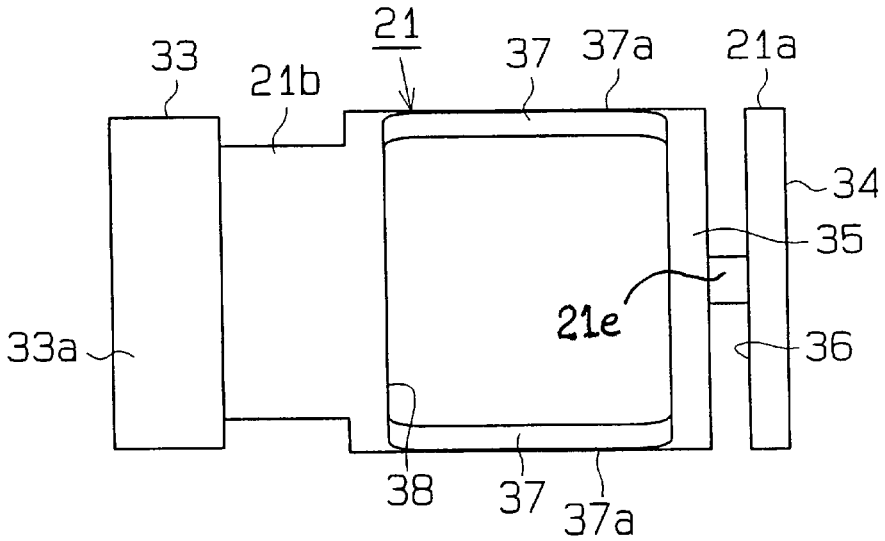
FIG. 6 is a plan view showing the piston of FIG. 5.

As shown in FIGS. 5 and 6, the space 38, which is opened toward two opposite sides of the piston 21, extends through the head 21*a* in a radial direction of the drive shaft 16. Two bridges 37 are provided between the skirt 21*b* and the second seal 35. The sliding surfaces 37*a* of the bridges 37 face generally toward the adjacent pistons 21. That is, each surface 37*a* generally faces the direction of a tangent to the swash plate 19 taken at the location of the corresponding shoes 22.

In the same manner as the above embodiments, the lateral forces associated with the inertial force of the piston 21 are received by the first and second seals 34, 35.

Like the first embodiment, the machining of the piston 21 and the assembly of the compressor is facilitated. The piston 21 of this embodiment is also light.

In the same manner as the first embodiment, the lateral forces associated with the frictional force produced between the swash plate 19 and the shoes 22 are received by the sliding surfaces 37*a*, which generally face a tangent to the swash plate 19 taken at the location of the corresponding shoes 22. Accordingly, the reciprocating movement of the piston 21 is further stabilized.

The shapes of the bridge 37 and the space 38 are not limited to the shapes described in the first, second, and third embodiments and may be altered arbitrarily.

Figure 7:
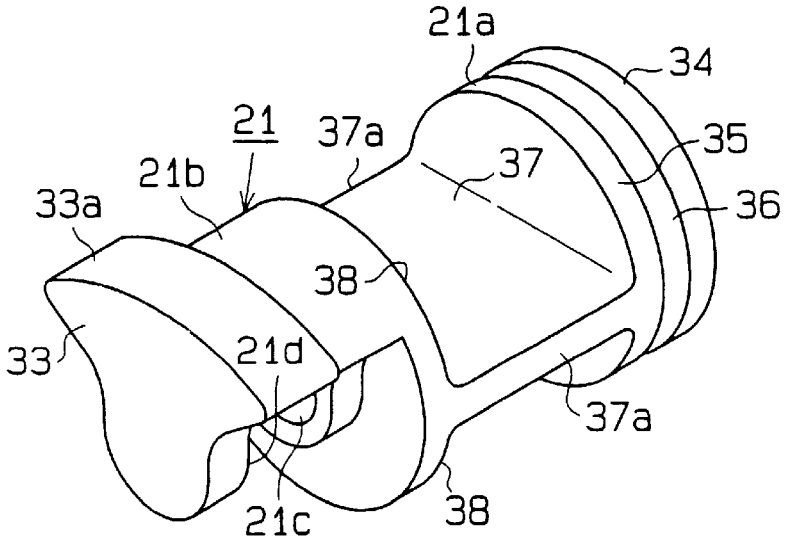
FIG. 7 is a perspective view showing a piston employed in a fourth embodiment according to the present invention.

For example, in a fourth embodiment according to the present invention, the bridge 37 of the piston 21 is flat and extends axially along the piston 21, as shown in FIG. 7. The bridge 37 of FIG. 7 has a pair of sliding surfaces 37*a*. Each sliding surface 37*a* generally faces a tangent to the swash plate 19 taken at the location of the corresponding shoes 22. A space 38 is located at each side of the bridge 37, as shown in FIG. 7.

Figure 8:
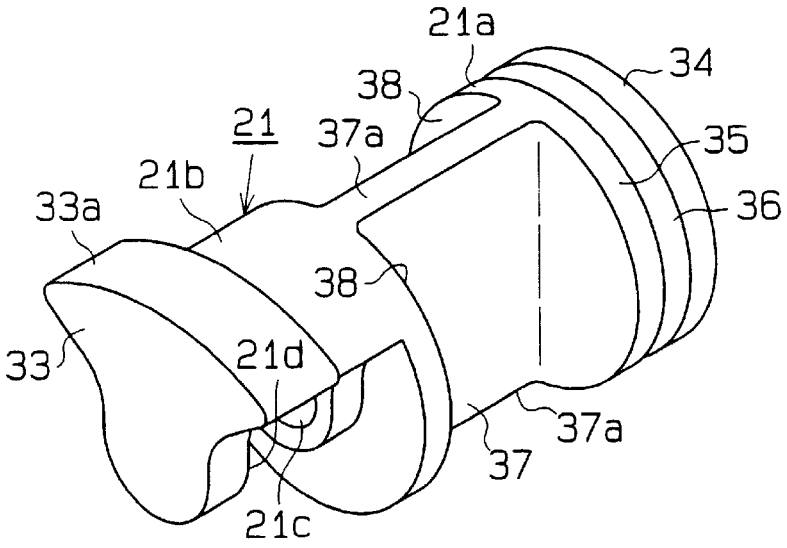
FIG. 8 is a perspective view showing a piston employed in a fifth embodiment according to the present invention.

FIG. 8 shows a fifth embodiment according to the present invention. Like the fourth embodiment, the bridge 37 of the piston 21 is flat and extends axially along the piston 21. The bridge 37 is oriented at a right angle with respect to the bridge 37 of the fourth embodiment. One of the sliding surfaces 37*a* faces toward the axis C0 of the swash plate 19 (or drive shaft 16) while the other sliding surface 37*a* faces the opposite direction. A space 38 is located at each side of the bridge 37, as shown in FIG. 8.

The application of the present invention is not limited to variable displacement compressors and may be embodied in a compressor having fixed displacement.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A compressor comprising:

a piston having a central longitudinal axis;

a cylinder bore for accommodating the piston, the cylinder bore having a cylindrical surface slidably supporting the piston, wherein the cylinder bore is directly open to a crank chamber whereby the piston is exposed to fluid pressure within the crank chamber;

a driving body located in the crank chamber and supported on a drive shaft, wherein the driving body is operably connected to the piston to convert rotation of the drive shaft to reciprocation of the piston;

a piston head formed on the piston for compressing gas supplied to a compression chamber defined by the piston head, the cylindrical surface and an end surface of the cylinder bore, wherein the piston head is located at a first end of the piston, the piston head including axially aligned respective first and second seals, each of the first and second seals having a continuously cylindrical surface which is slidably supported by the cylindrical surface of the cylinder bore, the first and second seals being spaced apart by a narrow width connecting element adjacent to the axis to provide a deep annular groove between the first and second seals;

a skirt integrally formed at a second end of the piston, which is opposite to the first end, wherein the skirt is coupled to the driving body;

a space that opens to a side of the piston, the space being located between the second seal and the skirt; and a bridge extending between the second seal and the skirt to connect the second seal with the skirt;

whereby at least at a bottom dead center position of the piston during reciprocation within the cylinder bore, the second seal is exposed to a fluid pressure within the crank chamber, and when a force acts on the piston in a direction transverse to the axis of the piston, the force is received by one of the first and second seals, and an oppositely directed force transverse to the axis of the piston is received by the other of the first and second seals.

2. The compressor according to claim 1, wherein the bridge occupies a position that includes the axis of the piston.

3. The compressor according to claim 2, wherein the space is annularly located around the bridge.

4. The compressor according to claim 1, wherein the bridge has a sliding surface for contacting the surface of the cylinder bore.

5. The compressor according to claim 4, wherein the driving body rotates to reciprocate the piston, and wherein at least a part of the sliding surface faces a direction that is generally tangential to the driving body with respect to a point where the piston is coupled to the driving body.

6. The compressor according to claim 4, wherein at least a part of the sliding surface faces toward the axis of the drive shaft when the piston is installed.

7. The compressor according to claim 1, wherein the piston has a piston ring attached to at least one of the first and second seals.

8. The compressor according to claim 1, wherein the driving body is a swash plate that is tiltably supported on the drive shaft, wherein the inclination of the swash plate varies in accordance with the difference between the pressure in the crank chamber and the pressure applied to the head, and wherein the piston moves by a stroke based on the inclination of the swash plate to control the displacement of the compressor, wherein the compressor further includes means for adjusting the difference between the pressure in the crank chamber and the pressure applied to the head.

9. A compressor including a piston, a cylinder bore for accommodating the piston, the cylinder bore directly open to a crank chamber whereby the piston is exposed to fluid pressure within the crank chamber, a drive shaft and a driving body rotatably located within the crank chamber, the driving body operably coupled to the piston to convert rotation of the drive shaft to reciprocation of the piston, the compressor comprising:

a first head located at a first end of the piston, the first head having a continuous peripheral surface that is slidably supported by a surface of the cylinder bore;

a second head connected to the first head by a rod located on a central longitudinal axis of the piston, the second head having a continuous peripheral surface that is slidably supported by the surface of the cylinder bore, the second head being spaced by said rod away from the first head to provide a deep annular gap between the first and second heads;

a skirt integrally formed at a second end of the piston, the skirt having means for coupling the skirt to the driving body;

a space defined between the second head of the piston and the skirt; and a bridge extending across the space between the second head and the skirt to connect the second head with the skirt;

whereby, when the piston is reciprocated, alternately opposite forces acting on the piston in directions transverse to the axis of the piston are received by each of the first and second heads, respectively.

* * * * *

UNITED STATES PATENT AND TRADEMARK OFFICE
CERTIFICATE OF CORRECTION

PATENT NO. : 5,953,980

DATED : September 21, 1999

INVENTOR(S) : Masaki OTA et al.

It is certified that error appears in the above-identified patent and that said Letters Patent is hereby corrected as shown below:

Title page, under "FOREIGN PATENT DOCUMENTS", second entry, after "0698735" insert --A2--.

Column 4, line 56, change "11*a*" to --11--; line 58, after "restriction" insert --33-- and delete "comes into".

Column 5. line 5, change "15*a*" to --15--; line 30, after "piston" insert --21--.

Signed and Sealed this

Eighth Day of May, 2001

*Attest:*

Nicholas P. Godici

NICHOLAS P. GODICI

*Attesting Officer*

*Acting Director of the United States Patent and Trademark Office*